United States Patent [19]

Gorrell

[11] Patent Number: 4,650,372

[45] Date of Patent: Mar. 17, 1987

[54] DRIVE SCREW PILE

[75] Inventor: Donald B. Gorrell, Houston, Tex.

[73] Assignee: The Dow Chemical Company, Midland, Mich.

[21] Appl. No.: 708,205

[22] Filed: Mar. 4, 1985

[51] Int. Cl.[4] ..... E02D 7/00

[52] U.S. Cl. ..... 405/232; 52/157

[58] Field of Search ..... 405/232, 237, 238, 239, 405/240, 241, 242, 243; 52/157

[56] References Cited

U.S. PATENT DOCUMENTS

| | | | |
|---|---|---|---|
| 101,379 | 3/1870 | Parker . | |
| 226,664 | 4/1880 | Kirkup . | |
| 996,688 | 7/1911 | Vernon-Inkpen . | |
| 1,791,368 | 2/1931 | Mullett | 52/157 |
| 1,960,639 | 5/1934 | Kuhn | 52/157 |
| 2,151,847 | 12/1937 | Greulich . | |
| 2,643,843 | 6/1953 | Brown | 52/157 |
| 3,797,257 | 3/1974 | Long . | |
| 3,952,523 | 4/1976 | Gale | 52/157 |
| 4,239,419 | 12/1980 | Gillen, Jr. | 405/232 |

FOREIGN PATENT DOCUMENTS

| | | | |
|---|---|---|---|
| 57-96128 | 6/1982 | Japan . | |
| 57-130626 | 8/1982 | Japan . | |
| 109616 | 6/1984 | Japan | 405/232 |
| 808594 | 2/1981 | U.S.S.R. . | |
| 863767 | 9/1981 | U.S.S.R. . | |
| 870586 | 10/1981 | U.S.S.R. . | |
| 983193 | 12/1982 | U.S.S.R. . | |

*Primary Examiner*—Henry C. Yuen
*Assistant Examiner*—Steven E. Warner
*Attorney, Agent, or Firm*—M. W. Barrow

[57] ABSTRACT

A drivable pile with a plurality of helical flanges affixed radially symmetrically about the external surface of an elongated pile member. In a preferred embodiment, two flanges are diametrically opposed at radial positions 180° apart with an axial pitch of 30° to the longitudinal axis. The helical flanges complete a sum total of approximately one turn along a portion of the length of the pile member and are removed slightly from the lower end of the pile.

11 Claims, 4 Drawing Figures

DRIVE SCREW PILE

FIELD OF THE INVENTION

The present invention relates to piles which are used to carry vertical loads and, more particularly, to piles having flanges along the length thereof arranged in the form of screw threads in order to increase the bearing loads and the upward vertical loads which the pile can withstand.

BACKGROUND OF THE INVENTION

In various areas of the country where bearing pressures of soil are low or unsuitable for structural purposes, it is common to employ one or more elongated load carrying elements placed in the soil beneath the structure. These elements are referred to in the industry as a pile or piling. These devices for transferring load between a structure and the underlying earth are typically of concrete, steel, or timber construction.

A standard pile depends on either skin friction, i.e., adhesion of soil to the surface of the pile, or end bearing to carry the load. In order to increase the skin friction, and hence the bearing load capability of piles, the geometry of piles has been altered in various ways to improve the load bearing resistance of the pile. For example, U.S. Pat. No. 2,151,847 utilizes the concept of a tapered wedge pile with reinforcing ribs which may add additional resistance.

In some applications, it would be desirable to provide a pile with a high resistance to uplifting, or vertical loading, as well as with a high bearing load capability, such as, for example, in anchoring electrical transmission towers. In various regions, especially where there is only shallow soil above the bedrock, the resistance to vertical loading is particularly critical because of the limited depth on which the pile can be driven. Piles depending only on skin friction to resist vertical loading are particularly unsuitable when changing conditions result in expansion and contraction of the soil surrounding the pile.

One approach has been to provide the pile with a flange, generally in the form of a screw thread, to increase its resistance to vertical loading. Numerous configurations of such flanges have been designed for piles in order to maximize their vertical loading capabilities. Examples of such piles may be found in U.S. Pat. No. 3,797,257; U.S. Pat. No. 101,379; U.S. Pat. No. 996,688; U.S. Pat. No. 4,239,419; Japanese Pat. No. 57,130626; Japanese Pat. No. 57,96128; USSR Pat. No. 983,193; USSR Pat. No. 870,586; USSR Pat. No. 808,594; and USSR Pat. No. 863,767. A major disadvantage of such piles is that, because of their high pitch and/or thread depth, they must be rotated or screwed into the soil, and cannot be driven by conventional pile driving equipment. In addition, these piles are generally heavily reinforced to minimize torsional failure during their screwed insertion into the soil, increasing their cost of manufacture. Moreover, such screwed piles are usually quite heavy and awkward to transport and to erect for driving into the soil.

On the other hand, drivable piles provided with a helical screw flange, such as, for example, that described in U.S. Pat. No. 226,664, have had limited practical utility. The driving of such a pile with conventional pile drivers, except with small piles used to anchor only relatively small and lightweight structures, creates an unequal stress on one side of the pile, with the result that the pile bends or fractures upon driving.

There exists, therefore, a need for a pile drivable with conventional pile drivers which is easily and inexpensively manufactured, transported and installed, and which has a high resistance to upward vertical loading.

SUMMARY OF THE INVENTION

The present invention provides a drivable pile which includes (a) an elongated member having a longitudinal axis, a longitudinal surface, a first end adapted to receive a driving force, and a second end adapted to penetrate earth, and (b) a plurality of radially symmetrical, helical flanges fixedly attached to the longitudinal surface of the elongated member. Preferably, the flanges are substantially longitudinally coextensive and equiangularly spaced with respect to the longitudinal axis of the elongated member.

The present invention provides a pile with a plurality of helical threads of low thread density which can be driven instead of rotated or screwed into the ground. The configuration of the pile allows frictional resistance of the soil in driving the pile to be exerted equally on each side of the pile. The pile therefore has less tendency to drive into the earth at an angle or fail due to bending. The weight and bulk of materials used in the pile can also be reduced, allowing the piles to be more easily transported and erected for driving.

Accordingly, the present invention provides a screw pile drivable with conventional pile driving equipment and which has an enhanced resistance to vertical loading due to flanges in the form of helical screw threads. The invention further provides piles having a reduced tendency to fail because of bending while being driven, and piles with increased and determinate resistance to uplift despite changes in soil conditions after the pile is driven.

DESCRIPTION OF THE PREFERRED EMBODIMENTS

Figure 1:
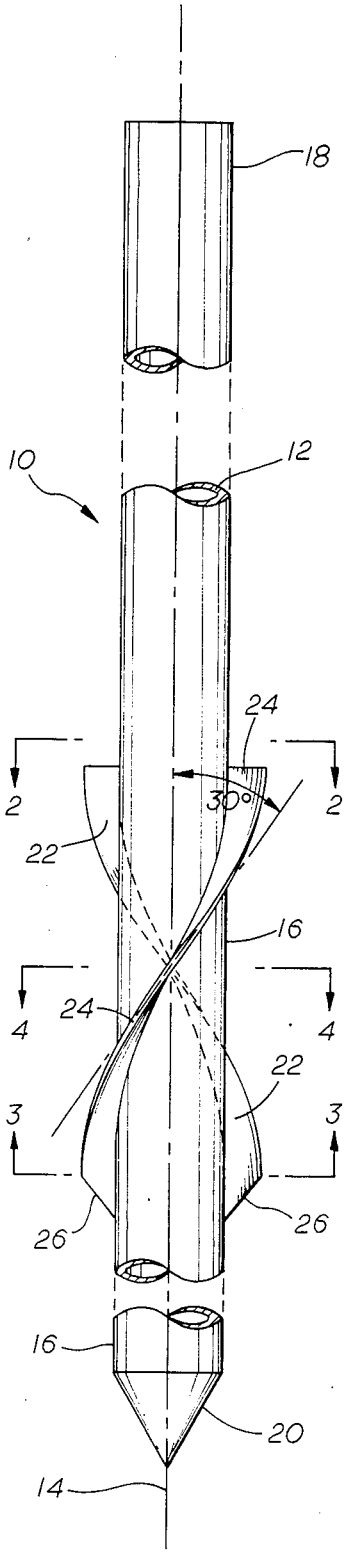
FIG. 1 is a perspective side view of a drivable pile with helical flanges according to the present invention.
Figure 2:
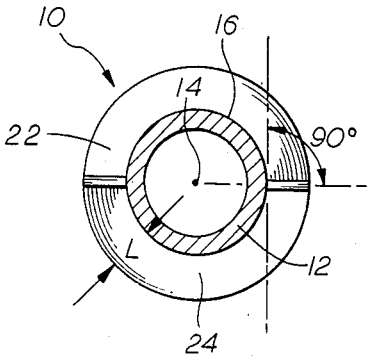
FIG. 2 is a cross-sectional view of the pile of FIG. 1 taken along the line 2—2.
Figure 3:
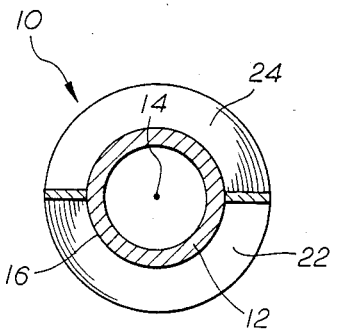
FIG. 3 is a cross-sectional view of the pile of FIG. 1 taken along the line 3—3.
Figure 4:
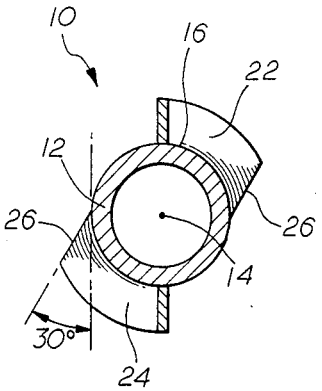
FIG. 4 is a cross-sectional view of the pile of FIG. 1 taken along the line 4—4.

Referring to the drawings, there is shown drivable pile 10 provided with elongated pile member 12 and helical flanges 22, 24. Elongated member 12 is provided with longitudinal axis 14, longitudinal surface 16, first end 18 adapted to receive a driving force, and second end 20 adapted to penetrate the earth. Elongated member 12 may have any suitable shape, such as, for example, cylindrical or conical, preferably a right circular cylinder, and may be constructed of any suitable material, preferably steel in the form of thick walled pipe. Although in some instances it may be desirable to provide a weld cap to improve end bearing resistance, second end 20 may be provided with no closure or preferably, a pointed, conical closure to facilitate driving.

Helical flanges 22, 24 are fixedly attached to longitudinal surface 12. Preferably, helical flanges 22, 24 are substantially longitudinally coextensive and equiangularly spaced with respect to longitudinal axis 14. In this embodiment, vertical forces due to soil resistance during driving of the pile are equalized on each side of the pile, thereby preventing bending and misalignment of the pile as it is driven into the soil. While more than two helical flanges may be provided as long as they are equiangularly spaced about longitudinal axis 14, the improvement in load capability is marginal in relation to the added expense of additional flanges.

Preferably, helical flanges 22, 24 terminate in spaced relation to second end 20 to facilitate penetration of the earth, especially in the initial stages of driving. A distance of about two feet is suitable for most applications. It is also preferred that helical flanges 22, 24 terminate in spaced relation to first end 18 to facilitate positioning and driving of pile 10. This distance should be sufficient so that helical flanges 22, 24 do not interfere with application of the driving force to first end 18. Generally, the lower the longitudinal position of helical flanges 22, 24, the greater the resistance to uplift.

Preferably, helical flanges 22, 24 complete a sum total of approximately one rotation about longitudinal axis 14; i.e., if two flanges are used, each flange preferably completes approximately one-half rotation; if three are used, one-third, etc. More rotation of helical flanges 22, 24 results only in marginal improvement in vertical loading capability in relation to the increased cost of additional flange rotation. Also, it is preferred that the flange terminations proximal second end 20 are provided with bevels 26 which are at an angle with respect to longitudinal surface 16 to facilitate driving of the pile into the earth, i.e. less than ninety degrees from a line tangent to longitudinal surface 16. Optimum results are obtained when the bevel is about thirty degrees from a line tangent to longitudinal surface 16.

In another preferred embodiment, helical flanges 22, 24 are positioned with an axial pitch of approximately 30° to longitudinal axis 14. Depending on soil conditions, this pitch facilitates driving of pile 10 and yet significantly improves the load carrying capability of the pile. Increasing the axial pitch substantially above about 30° may result in a pile which cannot be driven, or may excessively increase the force required to drive the pile with only marginal improvement in vertical loading capability. Conversely, reducing the axial pitch substantially below about 30° may lessen the driving force required while reducing the improvement in vertical loading capability. It is essential that the pitch not vary substantially along the longitudinal extent of each flange, or from one flange to another.

It is also preferred that helical flanges 22, 24 be positioned substantially orthogonally to longitudinal surface 16, i.e., the flanges project at about right angles to the attachment surface. Attaching the helical flanges at an angle which is substantially more or less than a right angle with respect to the longitudinal surface, i.e., angled upwardly, results in reduction in the required driving force and vertical loading capability similar to reducing the axial pitch substantially below 30°, or, with the helical flanges angled downwardly, an increase in the required driving force and vertical loading capability.

The dimensions and materials of helical flanges 22, 24 depend upon soil conditions, the load to be supported and other factors. While width L of the flanges may vary along the longitudinal axis, it is important that width L be substantially equivalent for all of the flanges at any given point along longitudinal axis 14. Width L should be sufficient to ensure that flanges 22, 24 remain embedded in the surrounding soil during expansion and contraction thereof resulting from changing conditions such as moisture content and temperature. For most applications, it is suitable to construct elongated pile member 12 of steel pipe and helical flanges 22, 24 of approximately 1 cm thick by approximately 5 cm wide steel bar which is attached to the pipe by welding.

In driving the pile into the earth, conventional pile driving equipment and procedures are used. Although it is not necessary to apply rotation to drivable pile 10 with the driving equipment, rotation will normally be observed as a result of soil resistance acting on the helical flanges. It is essential that the equipment used to drive pile 10 permits rotation of the pile.

After driving into the soil, the drivable pile must be prevented from rotating by a pile cap or other suitable means. If the structure permits rotation, the improved resistance to vertical loading resulting from the flanges may not be fully realized.

While I have described my invention above, many variations in the illustrated details, materials and dimensions may occur to those skilled in the art. It is intended that all such variations which fall within the scope and spirit of the appended claims to be embraced thereby.

I claim:

1. A drivable pile, comprising:

(a) an elongated member having a longitudinal axis, a longitudinal surface, a first end adapted to receive a driving force, and a second end adapted to penetrate earth when said driving force is applied to said first end; and (b) a plurality of radially symmetrical, helical flanges fixedly attached to at least a portion of said longitudinal surface, said flanges being substantially coextensive and equiangularly spaced with respect to said axis, terminating in spaced relation to said first and second ends, extending from said longitudinal surface in a direction substantially orthogonal to said axis, and completing a sum total of approximately one rotation about said axis, said flanges having an axial pitch of about 30° with respect to said longitudinal axis, said flange terminations proximal said second end of said elongated member being beveled with respect to said longitudinal surface at an angle of about 30° from a line tangent to said longitudinal surface, said angle of said bevels facilitating driving of the pile with application of only axially aligned forces.

2. The pile of claim 1, wherein said flanges are two in number and each completes approximately one-half rotation about said axis.

3. The pile of claim 1, wherein said elongated member is formed as a right circular cylinder.

4. The pile of claim 3, wherein said elongated member is pipe.

5. The pile of claim 3, wherein said flanges extend about 5 cm from said longitudinal surface.

6. A method of driving a flanged pile, comprising the steps of:

placing a pile in axial alignment with its desired emplacement in soil, said pile comprising (i) an elongated member having a longitudinal axis, a longitudinal surface, a first end adapted to receive a driving force and a second end adapted to penetrate earth when said driving force is applied to said first end, and (ii) a plurality of radially symmetrical, helical flanges fixedly attached to at least a portion of said longitudinal surface, said flanges being substantially longitudinally coextensive and equiangularly spaced with respect to said longitudinal axis, terminating in spaced relation to said first and second ends of said elongated member and having an axial pitch less than 45° which facilitates driving of said pile with application of only axially aligned forces, said flanges being beveled at said termination proximal said second end of said elongated member at an angle less than 90° from a line tangent to said longitudinal surface, said angle of said bevel facilitating driving of said pile with application of only axially aligned forces;

driving said pile into said soil by applying axially aligned force to said first end with equipment permitting free rotation of said pile, said pile rotating during said driving as a result of soil resistance acting on said flanges; and preventing further rotation of said driven pile so that said flanges substantially improve the vertical loading capability of said pile.

7. The method of claim 6, wherein said flanges have an axial pitch of about 30°.

8. The method of claim 6, wherein said flanges extend from said longitudinal surface in a direction substantially orthogonal to said longitudinal surface.

9. The method of claim 6, wherein said flanges complete a sum total of approximately one rotation about said axis.

10. The method of claim 6, wherein said pile alignment is substantially vertical.

11. The method of claim 6, wherein said prevention of further rotation of said pile is by means of a pile cap.

* * * * *